US005730441A

United States Patent [19]

Gibbons et al.

[11] Patent Number: 5,730,441

[45] Date of Patent: Mar. 24, 1998

[54] PINBALL MACHINE STRIKING MECHANISM

[75] Inventors: Chris Gibbons; Aidan Rutherford; Man Wai Leung, all of Hong Kong, Hong Kong

[73] Assignee: Saitek Ltd., Kwun Tong, Hong Kong

[21] Appl. No.: 727,249

[22] Filed: Oct. 8, 1996

[30] Foreign Application Priority Data

Oct. 10, 1995 [GB] United Kingdom ..... 9520737

[51] Int. Cl.[6] ..... A63F 7/30

[52] U.S. Cl. ..... 273/118 D; 273/127 R; 273/118 A

[58] Field of Search ..... 273/118 R, 118 A, 273/118 D, 119 R, 119 A, 121 R, 121 A, 127 R, 129 R

[56] References Cited

U.S. PATENT DOCUMENTS

| | | | |
|---|---|---|---|
| 2,058,202 | 5/1936 | Anderson . | |
| 2,308,297 | 1/1943 | Moxey et al. | 273/118 A |
| 2,610,058 | 9/1952 | Hooker | 273/121 A |
| 2,642,290 | 6/1953 | Moloney et al. | 273/118 A |
| 2,664,291 | 12/1953 | Petterson . | |
| 3,074,722 | 1/1963 | Davenport . | |
| 3,643,954 | 2/1972 | Meyer et al. | 273/129 V X |
| 4,354,680 | 10/1982 | Kmiec . | |
| 4,487,416 | 12/1984 | Peters . | |
| 4,504,057 | 3/1985 | Wiczer . | |
| 4,606,545 | 8/1986 | Ritchie . | |
| 4,840,375 | 6/1989 | Lawlor et al. . | |
| 5,181,722 | 1/1993 | Krutsch et al. | 273/121 A X |
| 5,284,342 | 2/1994 | Tanzer et al. | 273/121 A |
| 5,326,103 | 7/1994 | Lund et al. . | |
| 5,368,299 | 11/1994 | Driska | 273/129 R X |

*Primary Examiner*—Raleigh W. Chiu
*Attorney, Agent, or Firm*—Price, Gess & Ubell

[57] ABSTRACT

Conventional pinball machines have various mechanisms, some of which are under the control of the user, to enable the ball in play to be moved around the playing surface. An extra mechanism which can be incorporated is a rotated striking member, e.g. of oval shape. When a ball strikes this, it is driven away in a direction which is usually not radial relative the rotational axis of the member but which tends to be more tangential.

15 Claims, 3 Drawing Sheets

PINBALL MACHINE STRIKING MECHANISM

BACKGROUND TO THE INVENTION

Traditional pinball machines have a slightly inclined playing surface and a metal ball is projected to roll over that surface and various striking mechanisms are provided, some automatic and some under the control of the player, the skill being to use these to retain a ball in play for as long as possible.

One of the automatic mechanisms usually provided on the playing surface is of mushroom shape. Once a ball touches this, the mechanism is pulled downwardly very rapidly with the result that the ball is squeezed out between the head of the mushroom and the playing surface. This tends to result in the ball being expelled generally radially from the mushroom head and a modest increase in momentum may be imparted to the ball.

An object of the present invention is to provide a different form of automatic striking mechanism which will give a very different effect from that described above.

BRIEF SUMMARY OF THE INVENTION

According to the invention there is provided a pinball machine having one or more striking mechanisms incorporated into the playing surface of a type comprising a striking member which has an eccentric shape when seen in plan view, which is mounted substantially parallel to the playing surface and which is rotated about an upright axis, so that when the ball strikes the edge of the member extra momentum is imparted to the ball and it is driven away from the mechanism, usually in a direction which is not radial relative to the rotational axis of the member but which tends to be more tangential.

Therefore when a pinball machine includes such a striking mechanism an entirely different effect is achieved when the ball in play strikes it from the effect achieved using a traditional mushroom-shaped striking member. In practice one or more rotating striking mechanisms as described above, and one or more traditional mushroom-shaped striking mechanisms can be provided in a pinball machine to give a variety of effects during play.

The striking member can be rotated at a constant rate in one direction or could be rotated at a varying rate with change in the direction of rotation from time to time to give a further variation in play. For example, the rate of rotation can be from 300 to 4000 rpm, but is more preferably above 1000 rpm and most preferably from 1000 to 3000 rpm.

The eccentric shape of the striking member can vary from an oval shape to one having a number of arms, e.g. two to five, which extend away from the axis of rotation. Different eccentric shapes will impart differing momentum and direction to the ball. A preferred shape is oval.

The maximum radial extent of the striking member from its axis of rotation should preferably be from 1 to 6 cm, i.e. 1 to 6 times the radius of a ball, or more preferably 2 to 6 cm.

BRIEF DESCRIPTION OF THE DRAWINGS

An example of a pinball machine according to the invention will now be described with reference to the accompanying drawings, in which.

DESCRIPTION OF THE PREFERRED EMBODIMENT

Figure 1:
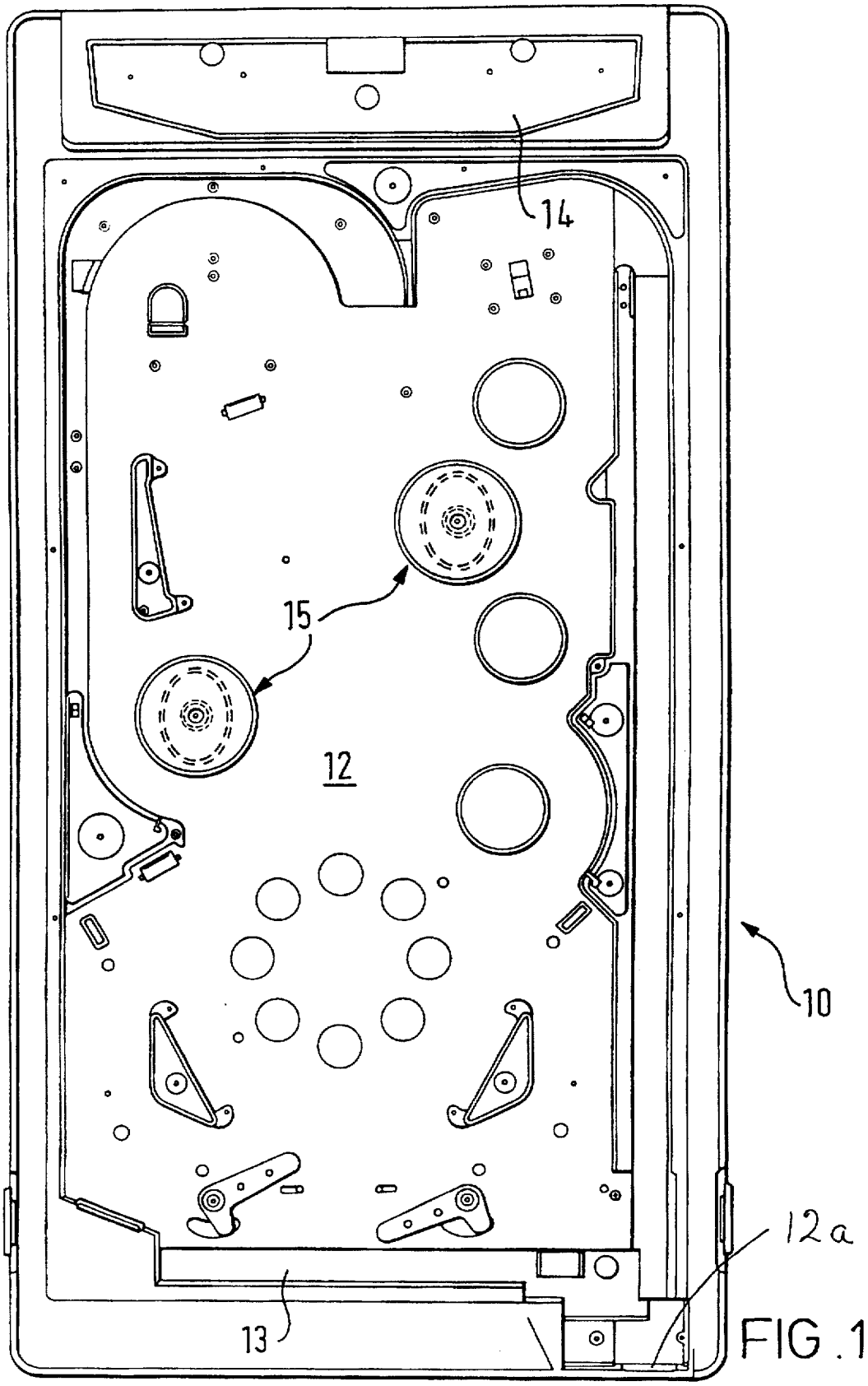
FIG. 1 is a plan view of the playing surface.

The pinball machine 10 shown in FIG. 1 is largely conventional a person of skill in this field is well aware of its conventional features. It has a substantially flat playing surface 12 over which a ball in play can roll. A striker mechanism under manual control is positioned near the lower right corner to put a ball into play and the ball then rolls over the playing surface in the usual way striking various upstanding items or surfaces, some of which are movable under manual control and the objective of the user is to keep the ball in play as long as possible before it enters a lower tray 13 and is lost from play. The score according to the ball striking particular objects is shown by a display 14. It is not felt that any more explanation of these conventional features is required.

Figure 2:
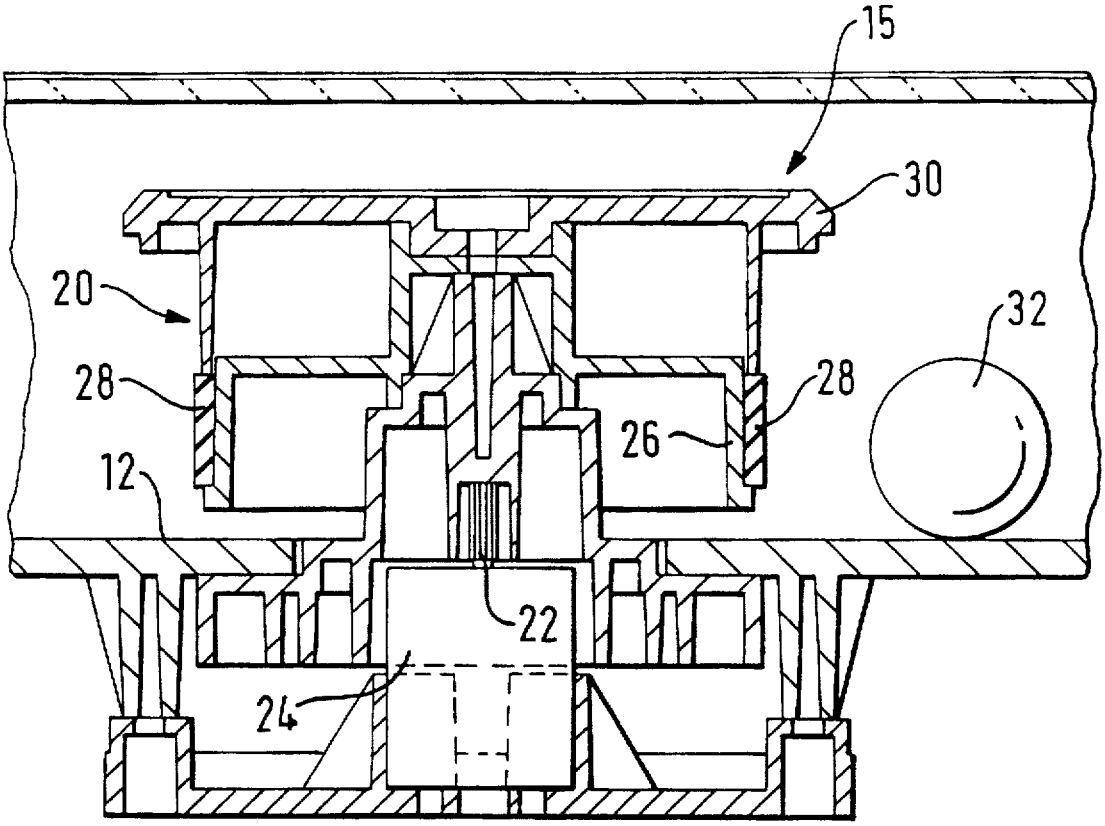
FIG. 2 is an enlarged sectional elevational detail of a striking mechanism.
Figure 3:
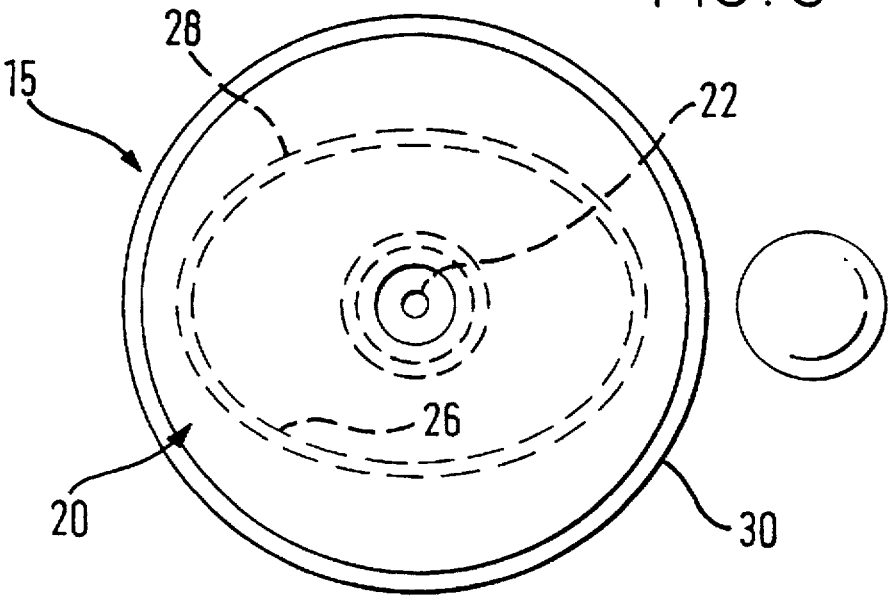
FIG. 3 is a plan view detail of the mechanism as shown in FIG. 2.

Positioned in the playing surface are two striking mechanisms 15 which are shown in more detail in FIGS. 2 and 3.

These striking mechanisms 15 comprise a rotatable striker 20 supported on a spindle 22 which is rotatably driven by a small electric motor 24 positioned below the playing surface 12 with appropriate brackets. The rotatable striker 20 comprises an oval shaped member 26 which has a hard upright edge surrounded by a ring of rubber 28 and which is positioned just above the playing surface 12, and an upper circular cap 30. The ring 28 is positioned, as best shown in FIG. 2, at a level such that it can contact a playing ball 32 as the ball rolls over the playing surface 12, whilst the cap 30 is positioned above the level of the ball 32.

In operation the striking mechanism 15 is set into rotation, and a ball is projected onto the playing surface by. It rolls down the surface in a conventional fashion but if it encounters one of the striking mechanisms 15, it hits the ring 28 and is flung out with increased momentum.

The outer surface of the oval-shaped member covered by the ring of rubber 28 that conforms to the configuration of the oval-shaped member will generally have a maximum radial extent from its axis of rotation of from 2 cm to 6 cm, that is, one to three times the diameter of the ball. The striking member can take other configurations as long as they are compatible with the rotating at a relatively high speed, for example, from 300 to 4000 rpm and preferably between 1000 to 3000 rpm. The striking member can be rotated at a constant rate in one direction, or can be rotated at a varying rate with the change in direction of rotation from time to time to give a further variation in play.

Figure 4:
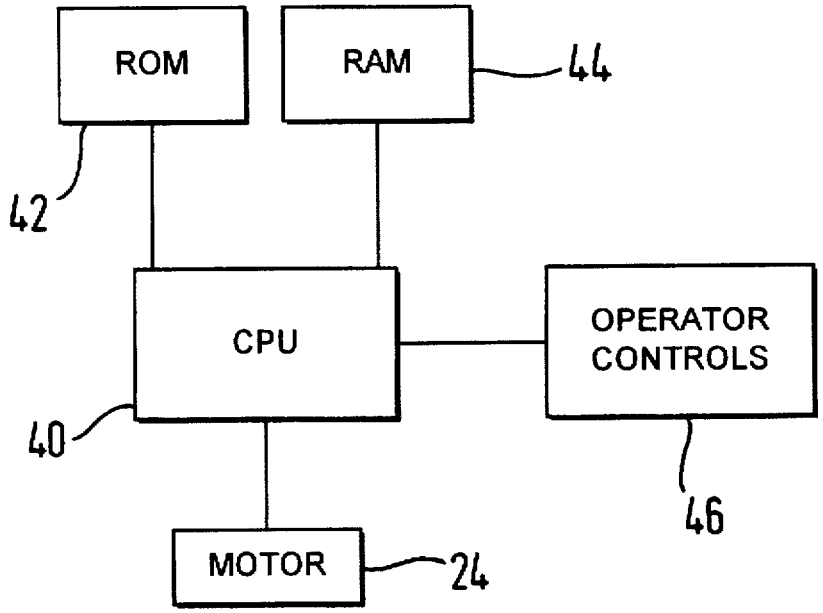
FIG. 4 is a schematic of the operator control system.

Reference can be made to FIG. 4 wherein a microprocessor system, such as a CPU 40 can control the overall operation of the pinball machine, including various striker mechanisms 15, mounted on the playing surface. A firmware program for the operation of the pinball machine, including keeping score and activating the various mechanisms, such as the striking mechanism 15, can be stored in a ROM 42, while various scoring values of a player and the attainment of various playing goal levels can be stored in the RAM 44. Operator controls 46 can input play options into the pinball machine and the CPU 40 can then implement the stored algorithm to control the play features. One of the play features is the activation of the motor 24 to control the direction and speed of rotation of a striking mechanism 15. Preferably, the motor can rotate in a clockwise or counterclockwise direction and can vary the relative rotational speed of the striking mechanism to provide further variations in game play, for example, the attainment of a certain score level could then cause the CPU 40 to alter the rotational characteristics of the striking mechanism 15 through control of the motor 24.

While the striking member 15 has been disclosed in a cross-sectional oval configuration for its outer surface, it would be possible to have other configurations, such as a number of radially extending arms, 1 to 8, and preferably 2 to 5, that could stand away from the axis of rotation.

While the device of the invention has been specifically described by way of a preferred example it, will be appreciated that changes and modifications may be made therein without departing from the spirit and the scope of the invention as defined in the appended claims.

We claim:

1. A pinball machine comprising:

a playing surface over which a ball in a play can roll, means for putting a ball into play over said playing surface, at lease one striking mechanism incorporated into said playing surface, and said striking mechanism including:

an eccentric shaped member as seen in plan view, an upright edge to said member, and means for supporting and rotating said member about an upright axis, including an upper circular cap mounted above the eccentric shaped member and of a dimension to surmount said eccentric shaped member, whereby when a ball in play strikes said upright edge, extra momentum is imparted to the ball and it is driven away from the mechanism.

2. A pinball machine according to claim 1 in which said means for supporting and rotating said member rotate it at a constant rate in one direction of rotation.

3. A pinball machine according to claim 1 in which said means for supporting and rotating said member rotate it at a varying rate of rotation with a change in direction of rotation from time to time.

4. A pinball machine according to claim 1 in which said means for supporting and rotating said member rotate it at a rate of from 300 to 3000 rpm.

5. A pinball machine according to claim 1 in which said eccentric shaped member is oval as seen in plan view.

6. A pinball machine according to claim 1 in which the maximum radial extent of said eccentric shaped member from said upright axis is 2 to 6 cm.

7. A pinball machine according to claim 1 in which said eccentric shaped member is of inverted bowl-shape, and in which an upright rotatable spindle is provided and said eccentric shaped member is attached to said spindle.

8. A pinball machine according to claim 1 in which said upright edge is covered with a rubber layer.

9. A pinball machine comprising:

a playing surface over which a ball in a play can roll;

means for putting a ball into play over said playing surface;

at lease one striking mechanism incorporated into said playing surface, and said striking mechanism including:

an eccentric shaped member, as seen in plan view, is of an inverted bowl-shape, and includes an upright edge on said member;

means for supporting and rotating said member about an upright axis includes a rotatable spindle attached to said eccentric shaped member, whereby when a ball in play strikes said upright edge, extra momentum is imparted to the ball and it is driven away from the mechanism; and an upper circular cap is supported for surmounting said eccentric shaped member.

10. A pinball machine according to claim 9 in which said means for supporting and rotating said member rotate it at a constant rate in one direction of rotation.

11. A pinball machine according to claim 10 in which said means for supporting and rotating said member rotate it at a rate of from 300 to 3000 rpm.

12. A pinball machine according to claim 9 in which said means for supporting and rotating said member rotate it at a varying rate of rotation with a change in direction of rotation from time to time.

13. A pinball machine according to claim 9 in which said eccentric shaped member is oval as seen in plan view.

14. A pinball machine according to claim 9 in which the maximum radial extent of said eccentric shaped member from said upright axis is 2 to 6 cm.

15. A pinball machine according to claim 9 in which said upright edge is covered with a rubber layer.

* * * * *